US005546113A

United States Patent [19]

Izumi

[11] Patent Number: 5,546,113

[45] Date of Patent: Aug. 13, 1996

[54] METHOD OF CONTROLLING THE PRINTING CONDITION OF A THERMAL PRINT HEAD

[75] Inventor: Hiroshi Izumi, Morioka, Japan

[73] Assignee: Alps Electric Co., Ltd., Tokyo, Japan

[21] Appl. No.: 165,222

[22] Filed: Dec. 10, 1993

[30] Foreign Application Priority Data

Dec. 14, 1992 [JP] Japan ..... 4-333135

[51] Int. Cl.[6] ..... B41J 2/36

[52] U.S. Cl. ..... 347/195

[58] Field of Search ..... 347/211, 195; 400/120.15

[56] References Cited

U.S. PATENT DOCUMENTS 4,590,484 5/1986 Matsushita ..... 346/76 PH 4,955,736 9/1990 Iwata et al. ..... 347/195

5,248,995 9/1993 Izumi ..... 347/195

*Primary Examiner*—Huan H. Tran

*Attorney, Agent, or Firm*—Guy W. Shoup; Patrick T. Bever

[57] ABSTRACT

The present invention is intended to provide a method of controlling the printing condition of a thermal print head provided with a comparatively large number of heating elements, capable of controlling the printing condition of the thermal print head by using a heating element driving circuit having a comparatively simple configuration and of dealing with increase in both printing speed and dot density. The method corrects the energizing time for each heating element (2) of a plurality of heating elements (2) of the thermal head (1) by adjusting the amount of heat to be generated by the heating elements (2) through a procedure comprising determining a plurality of logical values on the basis of the mode of energization of each heating element in the preceding printing cycles, and sequentially providing the logical values at predetermined time intervals.

3 Claims, 10 Drawing Sheets

| | |
|---|---|
| Taa | 50μsec |
| Ta | 38μsec |
| Tb | 32μsec |
| Tc | 22μsec |
| Td | 22μsec |
| Te | 56μsec |
| Tf | 5μsec |

| | |
|---|---|
| $T_{aa}$ | 50μsec |
| $T_a$ | 38μsec |
| $T_b$ | 32μsec |
| $T_c$ | 22μsec |
| $T_d$ | 22μsec |
| $T_e$ | 56μsec |
| $T_f$ | 5μsec |

FIG. 5

| | | | | | | | |
|---|---|---|---|---|---|---|---|
| PATTERN AA | 000<br>0000T<br>000 | | | | | | |
| PATTERN A | 00X<br>X000T<br>00X | 0X0<br>X000T<br>0X0 | | | | | |
| PATTERN B | 0XX<br>X000T<br>0XX | X0X<br>X000T<br>X0X | XX0<br>X000T<br>XX0 | 000<br>XX00T<br>000 | X0#<br>XX00T<br>X0X | X0X<br>XX00T<br>X0# | |
| PATTERN C | XXX<br>X000T<br>XXX | XX0<br>XX00T<br>XX0 | X0X<br>XX00T<br>X0X | 000<br>XXX0T<br>000 | 0XX<br>XX00T<br>0XX | 0XX<br>X0X0T<br>0X# | 0X#<br>X0X0T<br>0XX |
| PATTERN D | XXX<br>XX00T<br>XXX | XX0<br>XXX0T<br>XX0 | X0X<br>XXX0T<br>X0X | 0XX<br>XXX0T<br>0XX | 000<br>XXXXT<br>XXX | XXX<br>XXXXT<br>000 | |
| PATTERN E | XXX<br>XXXXT<br>XXX | | | | | | |

# : ENERGIZATION  0 : NON ENERGIZATION  X : EITHER ENERGIZATION OR NON ENERGIZATION

FIG. 10

| RANK VALUE R | SUBTRAHEND X |
|---|---|
| 1 ~ 3 | 0 |
| 4 ~ 6 | 2 |
| 7 ~ 9 | 4 |
| 10 ~ 11 | 6 |
| 12 | 8 |
| 13 | 10 |
| 14 | 14 |
| 15 ~ 32 | 16 |

FIG. 11

| $N_{on}$ VALUE | ADDEND Z |
|---|---|
| 0 | 0 |
| 1 | 3 |
| 2 | 6 |
| 3 | 9 |
| 4 | 12 |
| 5 | 15 |
| 6 | 16 |
| 7 | 16 |
| 8 | 16 |

FIG. 12

| K VALUE | ADJUSTING VALUE Y |
|---|---|
| -64 ~ -31 | -16 |
| -30 ~ -29 | -15 |
| -28 ~ -27 | -14 |
| -26 ~ -25 | -13 |
| ⋮ | ⋮ |
| -2 ~ -1 | -1 |
| 0 | 0 |
| 1 ~ 2 | 1 |
| 3 ~ 4 | 2 |
| ⋮ | ⋮ |
| 25 ~ 26 | 13 |
| 27 ~ 28 | 14 |
| 29 ~ 30 | 15 |
| 31 ~ 64 | 16 |

FIG. 13

| COUNT VALUE | RANK VALUE R |
|---|---|
| 0 ~ 199 | 1 |
| 200 ~ 399 | 2 |
| 400 ~ 599 | 3 |
| ⋮ | ⋮ |
| 6200 ~ 6399 | 32 |

METHOD OF CONTROLLING THE PRINTING CONDITION OF A THERMAL PRINT HEAD

BACKGROUND OF THE INVENTION

1. Field of the Invention

The present invention relates to a method of properly controlling the printing condition of a thermal print head incorporated into a thermal printer to print characters and the like in uniform print density.

2. Description of the Related Art

Generally, the thermal print head is formed by arranging a plurality of heating elements in a single or a plurality rows on a ceramic substrate, and power is supplied to the heating elements so as to make the heating elements generate heat selectively for printing. Since the substrate is heated by the heat generated by the heating elements, the heating element energizing time is varied by preceding condition correction and area condition correction according to the temperature of the substrate to avoid uneven printing.

Antecedent condition correction compensates a change in the temperature of the objective heating element, i.e., the heating element to be energized, attributable to a change in the ambient temperature, more specifically, a change in the temperature of the objective heating element itself and the temperature of a glaze layer of several ten micrometers in thickness heated by the heat generated by the objective heating element. Thus preceding condition correction corrects the energizing time according to the mode of energization of the objective heating element and the adjacent heating elements in the preceding printing cycles. Since the heating elements and the glaze layer have each a comparatively small heat capacity, the preceding condition correction may be made on the basis of the mode of energization of the heating elements in the several preceding printing cycles.

Area condition correction corrects the energizing time for energizing the objective heating element according to the position of the objective heating element on a printing line to prevent the difference in print density between the first character at the head of a line and the last character at the tail of the same line resulting from the gradual rise in the temperature of the substrate of the thermal print head from a temperature at the head of the line to that at the tail of the line when the heating elements are energized repeatedly for printing characters on the line. Since the heat capacity of the substrate is far greater than that of the heating elements, a correction for area condition correction must be determined on the basis of the mode of energization of the heating element in a time period preceding the energization of the heating element longer than a time period to be taken into consideration for preceding condition correction. Generally, energizing cycles repeated after the start of printing on a print line is counted and a correction for area condition correction is determined on the basis of the number of energizing cycles. Since the substrate has a comparatively large heat capacity, the correction for area condition correction is smaller than that for preceding condition correction.

Energizing time is determined for each heating element on the basis of corrections for preceding condition correction and area condition correction determined for each heating element. For example, the sum of a preceding condition correction time and an area condition correction time is added to a standard energizing time to determine an actual energizing time.

However, this conventional method of controlling the printing condition of a thermal print head, which determines a specific energizing time for each heating element, needs a timer for each heating element to set an energizing time for each heating element.

Although progressive miniaturization of heating elements for thermal print heads for improvement of print quality or progressive increase in the number of heating elements of the thermal print head for the enhancement of printing speed has been made in recent years, enhancement of printing speed and miniaturization of heating elements are incompatible with each other when the temperature of thermal print heads is controlled by the conventional method because conventional methods needs complicated calculations for each heating element.

In the conventional method of controlling the printing condition of a thermal print head, which needs a timer for each heating element, the number of timers increases with the increase of the number of the heating elements to increase the manufacturing cost of a controller for controlling the thermal print head. For example, although only twenty-four timers are necessary for controlling the temperature of a thermal print head having twenty-four heating elements, forty-eight timers, 128 timers and 160 timers are necessary for controlling thermal print heads respectively having forty-eight heating elements, 128 heating elements and 160 heating elements, respectively. Thus, the manufacturing cost of a controller for controlling the thermal print head increases with increase in the number of the heating elements of the thermal print head.

SUMMARY OF THE INVENTION

Accordingly, it is an object of the present invention to provide a method of controlling the temperature of a thermal print head, capable Of solving those problems in the conventional methods, of enabling-a driving circuit having a simple configuration to control the temperature of a thermal print head having an increased number of heating elements and of enabling both enhancement of printing speed and miniaturization of heating elements.

Another object of the present invention is to provide a method of controlling the printing condition of a thermal print head, capable of controlling the heat generation of the thermal print head by adjusting the energizing time for each heating element and comprising determining a plurality of divided logical values on the basis of the mode of energization of each heating element in the preceding printing cycles and determining the energizing time for each heating element by sequentially sending out the plurality of logical values at predetermined time intervals.

The method of controlling the printing condition of a thermal print head, in accordance with the present invention calculates the energizing time by using logical values and controls the temperature of the thermal print head by sequentially sending out 8-bit or 16-bit logical values. Calculation of logical values requires time which is a fragment of time required by the conventional method, does not need any complicated adders or multipliers needs hard ware having a simple configuration. Thus, the method of the present invention can be very advantageously applied to high-speed thermal print heads.

Since the calculated logical values are sent out at predetermined time intervals, the method needs only a few timers, which is 1/10 of less of the number of timers required by the conventional method.

BRIEF DESCRIPTION OF THE DRAWINGS

The above and other objects, features and advantages of the present invention will become more apparent from the following description taken in connection with the accompanying drawings, in which:

FIG. 5 is a table showing preceding condition correction patterns;

FIG. 10 is a table showing rank values and corresponding subtrahends to be used by the method of the present invention;

FIG. 11 is a table showing $N_{on}$ values and corresponding addends to be used by the method of the present invention;

FIG. 12 is a table showing K values and corresponding adjusting values to be used by the method of the present invention; and FIG. 13 is a table showing count values and corresponding rank values to be used by the method of the present invention.

DETAILED DESCRIPTION OF THE PREFERRED EMBODIMENTS

A method of controlling the heating condition of the heating element of a thermal print head provided with a single row of 160 heating elements, in a preferred embodiment according to the present invention will be described hereinafter first with reference to FIGS. 1 and 13.

Figure 1:
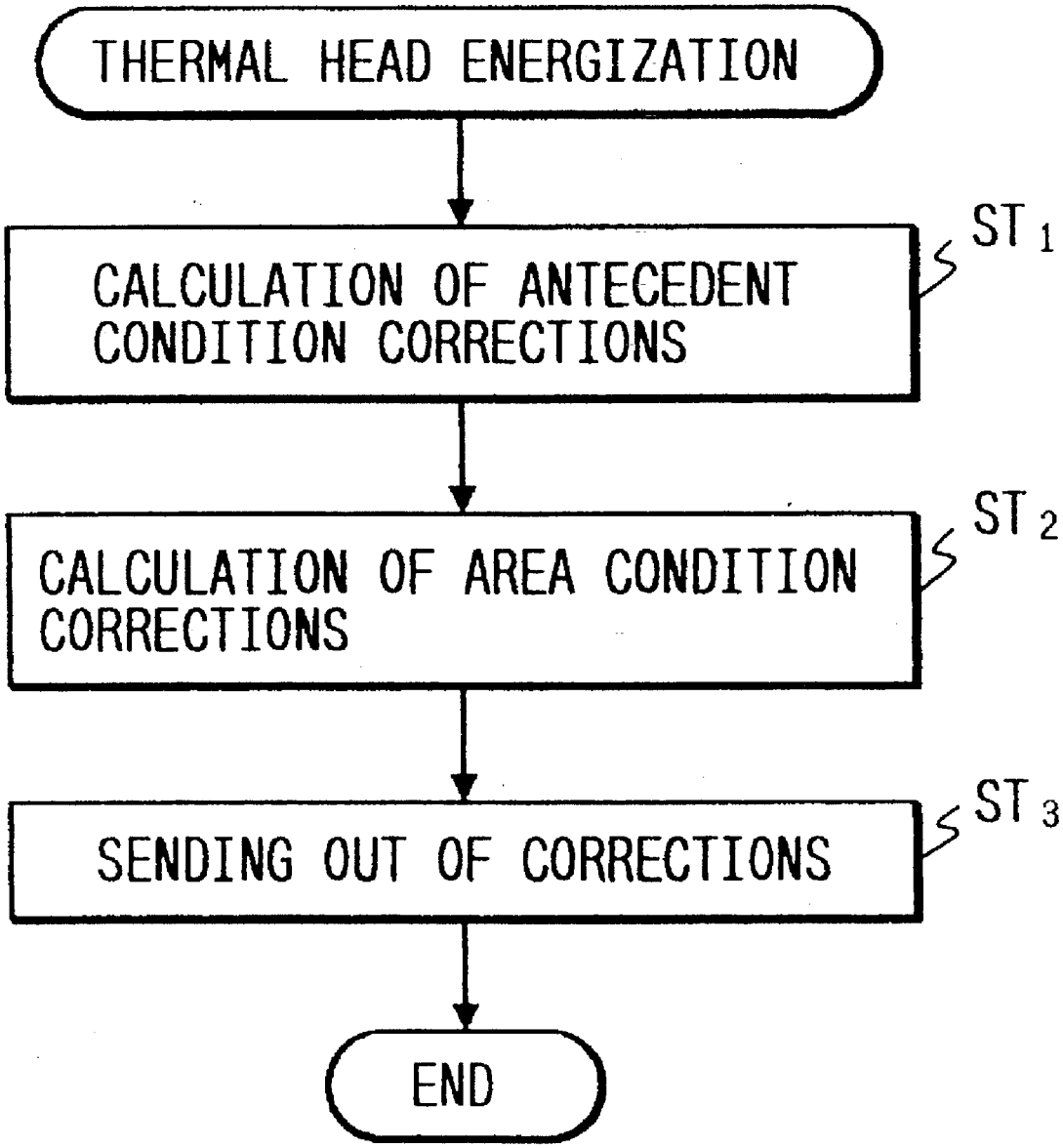
FIG. 1 is a flow chart of an energizing time determining procedure to be carried out by a method of controlling the printing condition of a thermal print head, in a preferred embodiment according to the present invention.

Referring to FIG. 1, preceding condition corrections for all the heating elements of the thermal print head are calculated in step ST1, area condition corrections for all the heating elements are calculated in step ST2 and the heating elements are energized respectively for corrected energizing time periods in step ST3.

The preceding condition corrections calculated in step ST1 are represented by six logical values AA, A, B, C, D and E. The area condition corrections calculated in step ST2 are represented by thirty-two logical values F[1] to F[32], which will be described later. The number of bits of each logical value is equal to the number of the heating elements of the thermal print head, 160. For example, the nth heating element is energized when the nth bit of the 160-bit data is logical 1 and is not energized when the same is logical 0.

Figure 2:
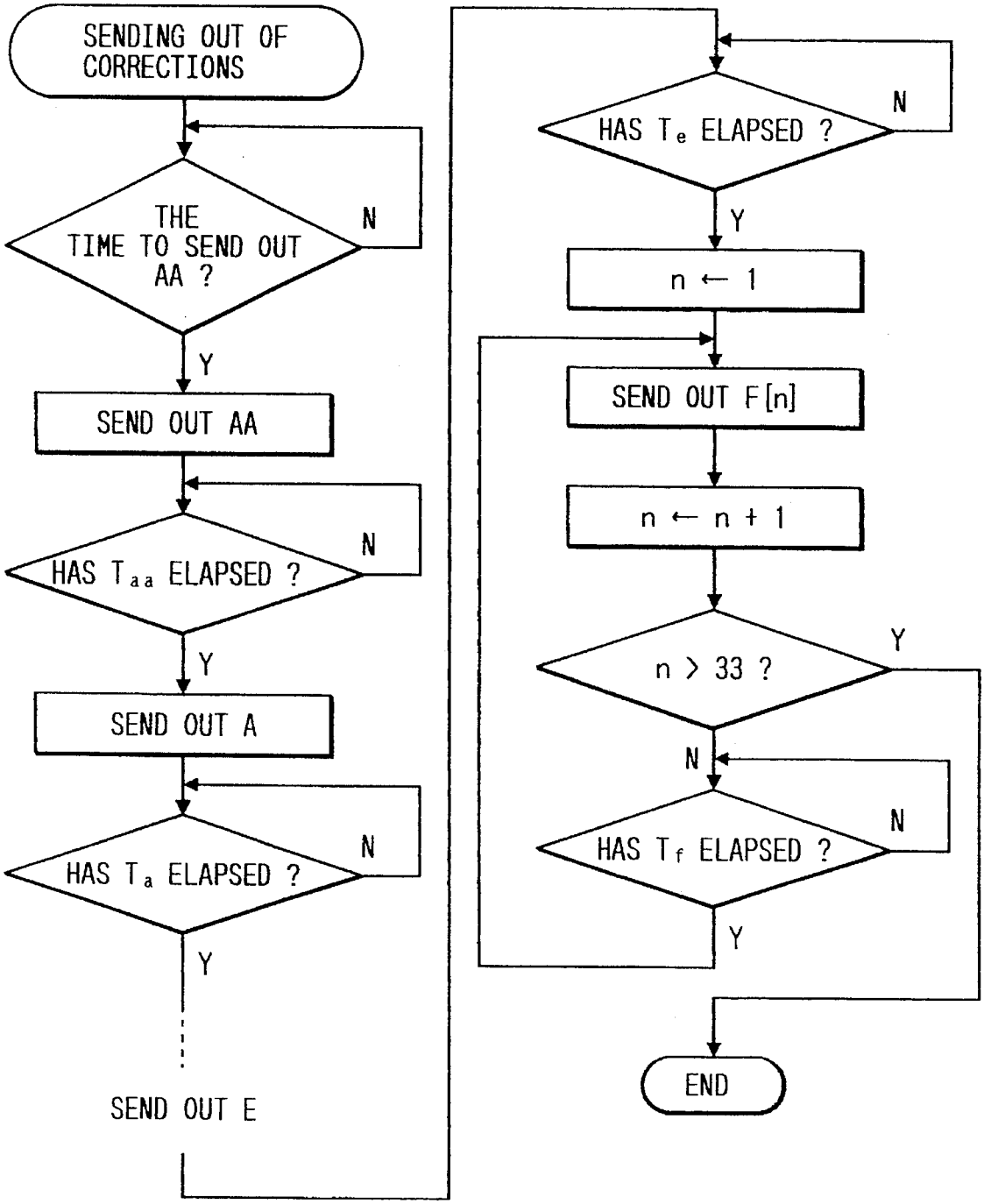
FIG. 2 is flow chart of an energization signal output procedure to be executed in step ST3 of the energizing time determining procedure of FIG. 1.
Figure 3:
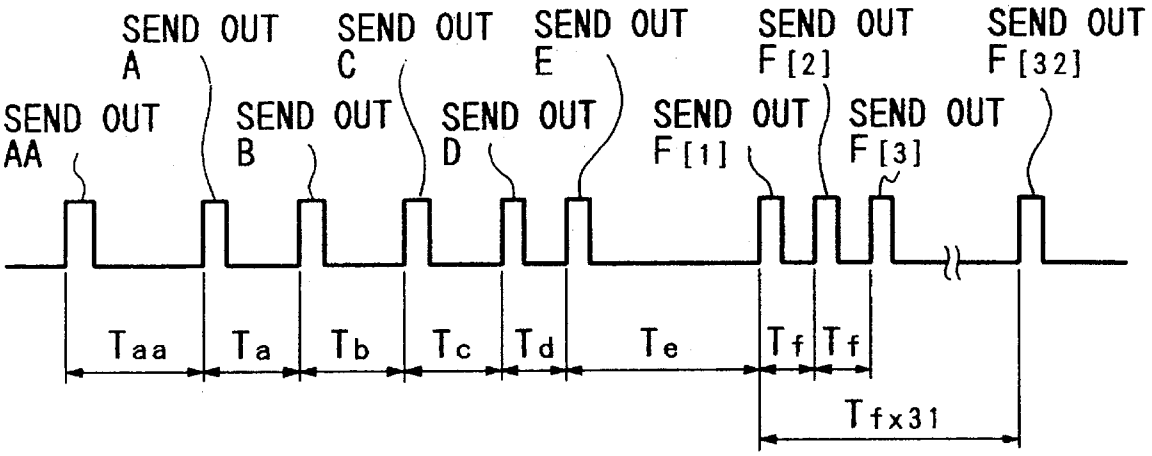
FIG. 3 is a timing chart of assistance in explaining the energization signal output procedure of FIG. 2.

Referring to FIGS. 2 and 3, first the preceding condition correction AA is provided at energizing time, the preceding condition correction A is provided after a predetermined time $T_{aa}$ has elapsed since the preceding condition correction AA was provided, and then the preceding condition corrections B, C, D and E are provided sequentially in the same manner. After a predetermined time $T_e$ has elapsed since the preceding condition correction E was provided, the area condition corrections F[1] to F[32] are provided sequentially at predetermined time intervals $T_f$. All the bits of the area condition correction F[32] are logical 0s, and all the heating elements are not energized when the area condition correction F[32] is provided. Thus, energizing time for each heating element is determined by using the sum of the 38 (=6+32) corrections. The 160-bit data are provided sequentially at predetermined time intervals for all the heating elements to control energizing time for each of the 160 heating elements.

The points of time to provide the 160-bit data are determined by timers, and the 160-bit data are provided by the interrupt handling operation of the CPU or by a DMA procedure for faster provision of the 160-bit data. The timers can be set respectively for seven individual times $T_{aa}$ to $T_f$. The timer which is set repeatedly for the time $T_f$ to provide thirty-one outputs in each heating element energizing cycle.

The calculated logical values are transferred to the thermal print head by the procedure shown in FIG. 2 at the points of time shown in FIG. 3. A known procedure may be used for the same purpose.

Figure 6A:
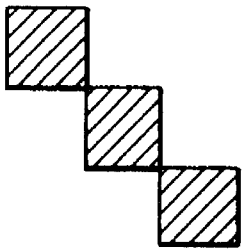
FIG. 6(a) PRIOR ART
FIGS. 6(*a*) and 6(*b*) are diagrammatic views comparatively showing oblique lines printed by a thermal print head temperature-controlled by the conventional method and oblique line printed by a thermal print head temperature-controlled by the method of the present invention, respectively.
Figure 6B:
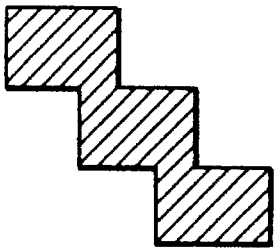

A preceding condition correction determining procedure to be carried out by the method in this embodiment will be described hereinafter with reference to FIGS. 4 to 6.

Figure 4:
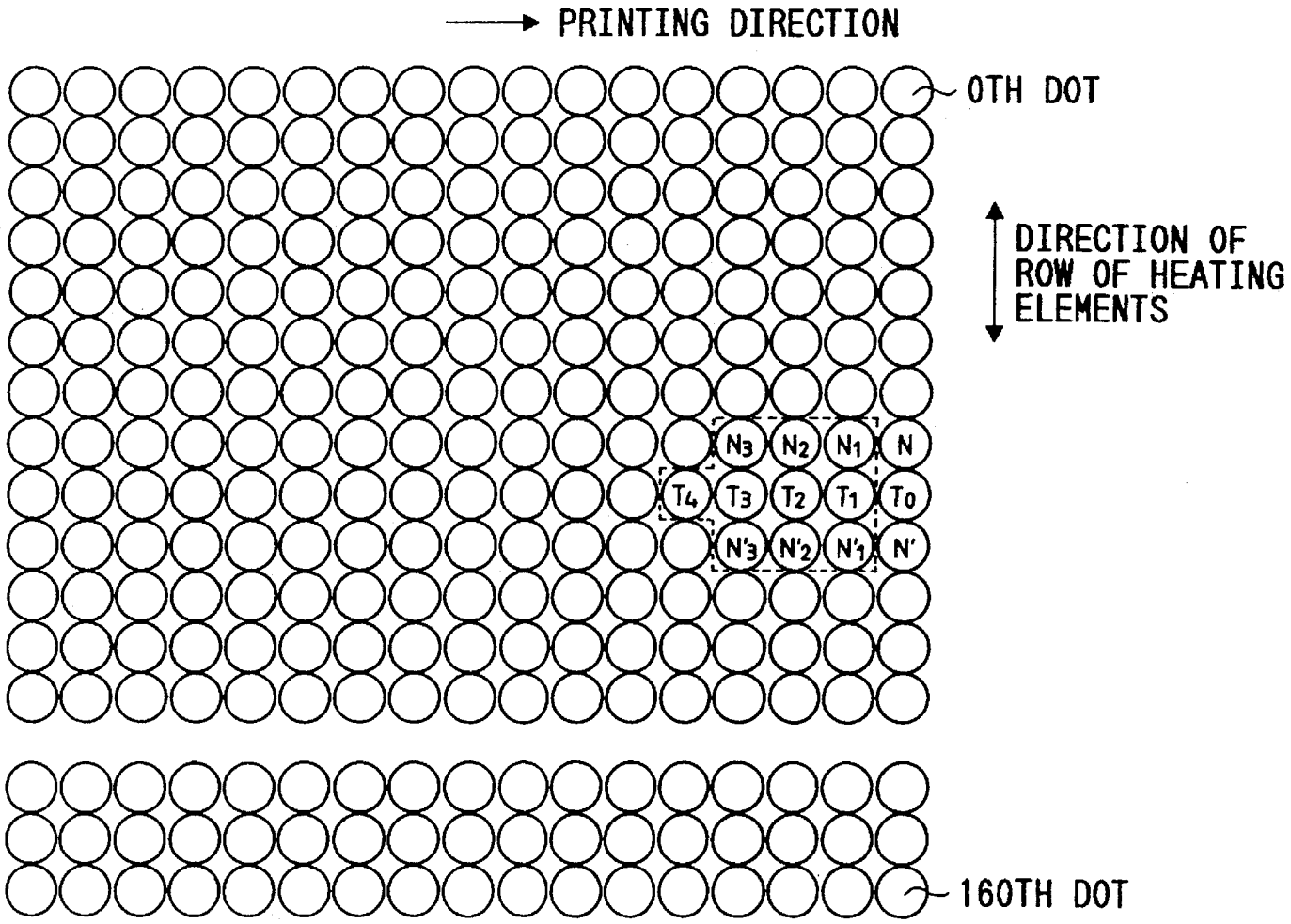
FIG. 4 is a diagrammatic view of assistance in explaining a procedure for determining the mode of heating element energization in the preceding printing cycles.

Referring to FIG. 4, a heating element $T_0$ is an objective heating element, which will be referred to as "target element" hereinafter, vertical rows each of the 160 heating elements other than a vertical row of the 160 heating elements at the right-hand end are those in the preceding printing cycles. Reference is made to the conditions of the heating elements enclosed by dotted lines in the preceding printing cycles to determine a preceding condition correction for the target element $T_0$.

Reference is made to the energization condition (ON or OFF) of the target element $T_0$ in the preceding four printing cycles and the respective energization conditions of the upper adjacent heating element N and the lower adjacent heating element N' in the preceding three printing cycles to determine the preceding condition correction for the target element $T_0$. The energization condition indicates only whether or not the heating element was energized in the relevant printing cycle and need not take into account the duration of energization, because the heating elements are heated at a substantially constant temperature when the duration of energization is appropriate, and the ambient temperature is not dependent on the duration of energization of the heating elements. Thus, the preceding condition correction for the target element is determined by information of ten bits representing the ten states of energization in the preceding ten printing cycles, so that a dot can be printed in a satisfactory print quality.

The heating elements in the present and preceding printing cycles $N_1$ to $N_3$, $T_0$ to $T_4$ and $N_1'$ to $N_3'$ are assigned respectively to the ten bits as shown in FIG. 5, in which a bit "T" represents the target element, a bit "#" represents an energized heating elements and the value of the bits # is logical value 1, a bit "O" represents a nonenergized heating element and the value of the bit O is logical value 0, and a bit "X" represents either an energized heating element or a nonenergized heating element.

When deciding a preceding condition correction, the patterns AA, A, B, C, D and E are compared sequentially in that order with actual preceding condition information. When the pattern AA coincides with the actual preceding condition information, a bit corresponding to the preceding condition correction AA is set to logical value 1, similarly, when the pattern A, B, C, D or E coincides with the actual preceding condition information, a bit corresponding to the preceding condition correction A, B, C, D or E is set to logical value 1.

The comparison of the patterns with the actual preceding condition information for determining a preceding condition correction is performed only when the target element is to be energized. When the target element is not to be energized, i.e., when value of the bit representing the target element is logical value 0, it is decided that none of the patterns AA to E coincides with the actual preceding condition information and that the preceding condition correction is zero. When the target element is not to be energized, an area condition correction is zero and the target element is not energized.

The patterns are constructed so that, when a pattern coincides with the actual preceding condition information, the lower patterns (the lower pattern includes the higher patterns) coincide necessarily with the actual preceding condition information. For example, when the pattern C coincides with the actual preceding condition information, the patterns D and E coincide with the actual preceding condition information. When the pattern C coincides with the actual preceding condition information, the corresponding bits of the preceding condition corrections C, D and E are set to logical value 1, and the heating elements represented by bits of logical value 1 are energized in the time intervals $T_c$, $T_d$ and $T_e$, and the corresponding heating of $T_c$, $T_d$ and $T_e$. FIG. 3 shows appropriate time intervals elements are energized for a time corresponding to the sum indicated by $T_a$, $T_b$, $T_c$, $T_d$ and $T_e$. Area condition correction to be carried out after F[0] will be described later.

The lower patterns can be formed so as not to include the upper patterns. When the lower pattern does not include intermittently in the period between $T_a$ and $T_e$. If the the upper patterns, the heating elements are energized heating elements are energized intermittently, the print density will vary depending on the ON-OFF speed. Therefore, the patterns are formed so that the lower patterns include the upper patterns.

As shown in FIG. 5, the bit corresponding to the target element $T_o$ must be logical value 1 and the bits corresponding to the heating elements $T_1$ to $T_4$, $N_1$ to $N_3$ and $N_1'$ to $N_3'$ must be logical value 0 in the pattern AA, which is expressed by the following logical expression.

$$AA=\overline{T_0+T_1+T_2+T_3+T_4+N_1+N_2+N_3+N_1'+N_2'+N_3'}$$

Logical operation using this logical expression is carried out for each target element to obtain a preceding condition correction AA.

Although this logical expression holds good for individual bits, this logical expression holds good also for bits on an assumption that $T_1$=160 bits, $N_1$ corresponds to a bit obtained by shifting $T_1$ by one bit to the right, and $N_1'$ corresponds to a bit obtained by shifting $T_1$ by one bit to the left. The operation need not be performed for each bit and may be performed for a byte (eight bits) or for a word (sixteen bits). This embodiment performs the operation for each byte.

Substituting $N_{a_1}=N_1+N_1'$, $N_{a_2}=N_2+N_2'$ and $N_{a_3}=N_3+N_3'$ into this logical expression, $$AA=\overline{T_0+T_1+T_2+T_3+T_4+N_{a_1}+N_{a_2}+N_{a_3}}$$

Logical expression for A is:

$$A=\overline{T_0+(T_1+T_2+T_3+N_2+N_2'+N_3+N_3')*(T_1+T_2+T_3+N_1+N_1'+N_3+N_3')}$$

Modifying this logical expression by Boolean algebra, $$A=\overline{T_0+T_1+T_2+T_3+N_{a_3}+N_{a_a}*N_{a_2}}$$

Substituting $N_{am}'=N_{a_1}*N_{a_2}$, $$A=\overline{T_0+T_1+T_2+T_3+N_{am}'+N_{a_3}}$$

Similarly, for B, C, D and E, $$B=\overline{T_0+T_1+T_2+N'''*(N_{aa}*T_3+N_{am})}$$

$$C=\overline{T_0+T_1+N''*(N_{aa}*T_2+N_{am}*T_3)}$$

$$D=\overline{T_{0+N'*}(T_{1+}N_{am}*T_2)}$$

$$E=T_0$$

where $$N'''=N_{a_2}+\overline{N_{a_i}}$$

$$N''=D_3N_{a_3}+\overline{N_{a_1}}$$

$$N'=(N_a+N_2+N_3)*(N_1'+N_2'+N_3')$$

$$N_{am=Na_1}*N_{a_2}*N_{a_3}$$

$$N_{am}'=N_{a_1}*N_{2_2}$$

$$N_{aa}=N_{a_1}+N_{a_2}+N_{a_3}$$

The foregoing logical expressions are formed for a desired pattern.

Operation using the foregoing logical expressions is carried out by software or hardware. When a desired final speed is high, it is desirable to use hardware. An appropriate method of operation using the foregoing logical expressions may be selected from among various methods, taking into consideration design conditions and such. Operation using the foregoing logical expression can be efficiently carried out by any suitable method, because 8-bit or 16-bit data are processed.

In the example shown in FIG. 5, part of the patterns B and C has "#" indicating "energized". The bits represented by "#" corresponds to the heating elements $N_1$ and $N_1'$. Therefore, the energizing time when the Heating element $N_1$ or $N_1'$ is energized is longer than the energizing time when both the heating elements $N_1$ and $N_1'$ are not energized; that is, the patterns are designed so that the energizing time is increased when the temperature around the heating element is higher. Such a mode of energizing the heating element contradicts with the foregoing description. Reasons for energizing the heating element in such a mode will be described hereinafter.

Since the respective temperatures of the heating elements and the substrate increases during printing operation, the temperature of the thermal head is controlled by correcting the energizing time to supply power to each heating element taking into consideration the increase of the temperatures of the heating elements and the substrate so that dots are printed in a uniform density. However, it is known from the observation of the printed dots that the correction of the energizing time only on the basis of the increase of the temperatures of the heating elements and the substrate is not sufficiently effective in printing dots in a uniform density. For example, if the energizing time is corrected rigorously for printing oblique lines, there is a tendency for the strings of dots to deteriorate as shown in FIG. 6(*a*). When printing dots in oblique lines, it is desirable that the dots are blurred slightly to form the oblique lines with strings of dots having satisfactory continuity.

Therefore, when the heating elements $n_1$ and $N_1'$ are to be energized for printing dots in the example shown in FIG. 5, the energizing time to energize the heating elements $N_1$ and $N_1'$ is increased to improve the continuity of the dots so that oblique lines can be formed in a satisfactory print quality.

A procedure for area condition correction will be described hereinafter with reference to FIGS. 7 to 13.

Figure 7:
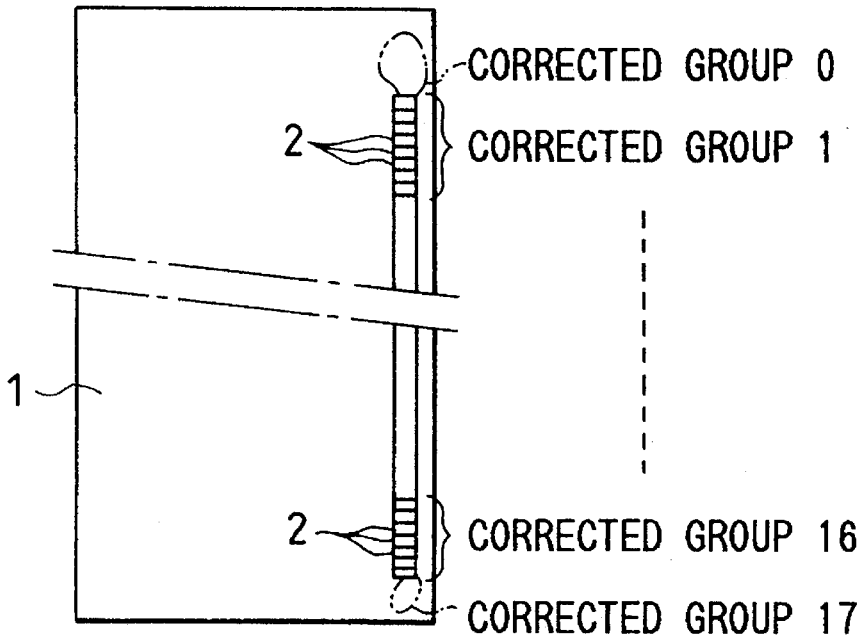
FIG. 7 is a plan view of a thermal print head to be controlled by the method of the present invention.

Referring to FIG. 7, the heating elements arranged in a vertical row are divided into correction groups, and imaginary correction groups are provided at the opposite ends of the row. The correction groups are subjected to correction individually so that the difference between the respective temperatures of the correction groups is reduced to the least possible extent. Calculation for area condition correction uses an energizing time unit smaller than the least energizing time. When the area condition correction is an integral multiple of the least energizing time, the area condition correction is used as the energizing time. When the area condition correction is not an integral multiple of the least energizing time, a query is made to see whether the heating element is at an odd-numbered position or whether at an even-numbered position on the row of heating elements, the fragment of the area condition correction for one of the heating elements at one of the positions not greater than the least energizing time is rounded up to determine an area condition correction which is an integral multiple of the least energizing time for the heating element, and the fragment of the area condition correction smaller than the least energizing time is omitted to determine an area condition correction which is an integral multiple of the least energizing time for the other heating element.

As shown in FIG. 7, the 160 heating elements 2 are divided into twenty correction groups, i.e., 1st to 20th correction groups, each of the eight heating elements 2, and the imaginary correction groups, i.e., the 0th and 21st correction groups, are provided adjacent to the 1st and 20th correction groups, respectively. In the following description, any unspecified correction group will be designated as "ath correction group".

Figure 8:
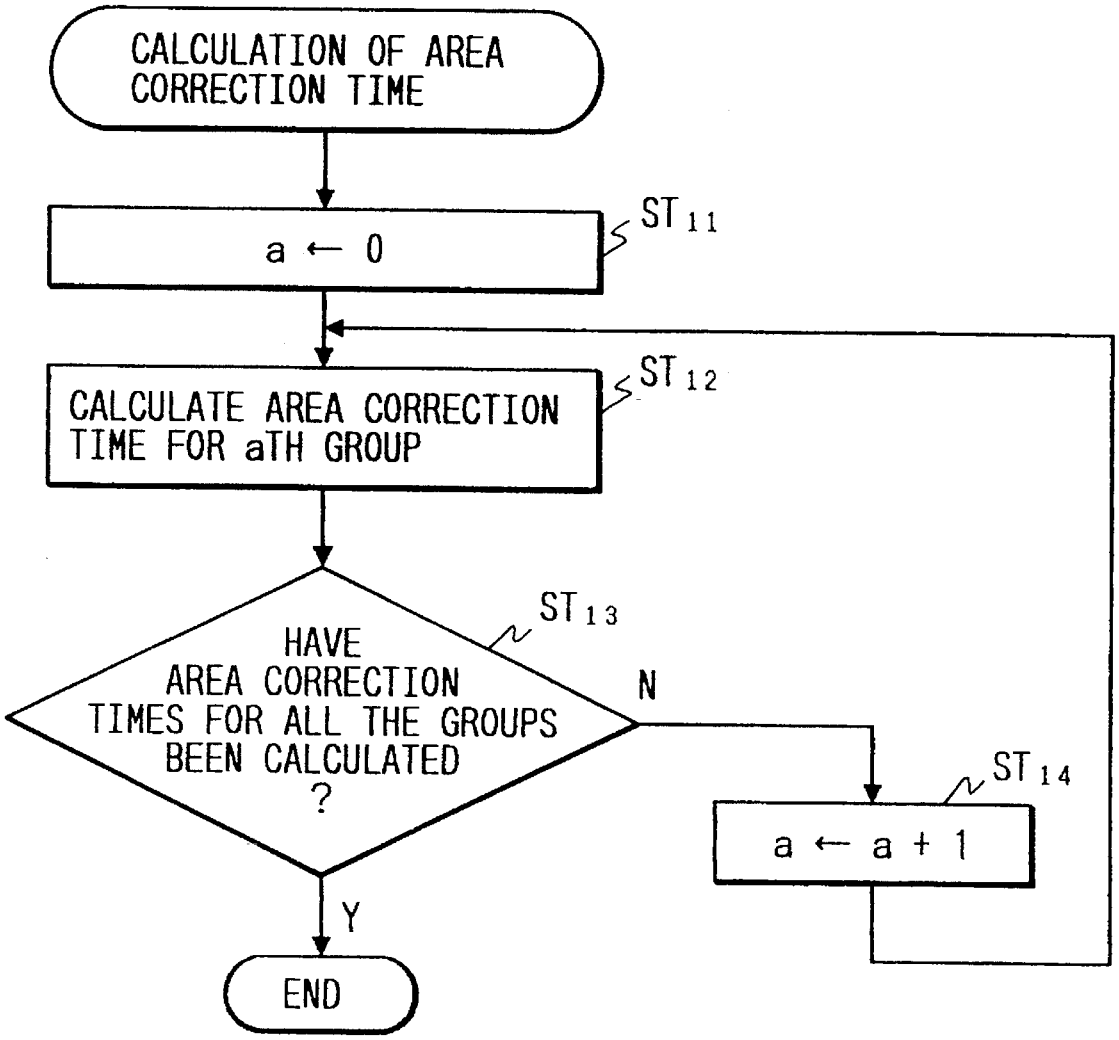
FIG. 8 is a flow chart of an area condition correction procedure to be carried out by the method of the present invention.
Figure 9:
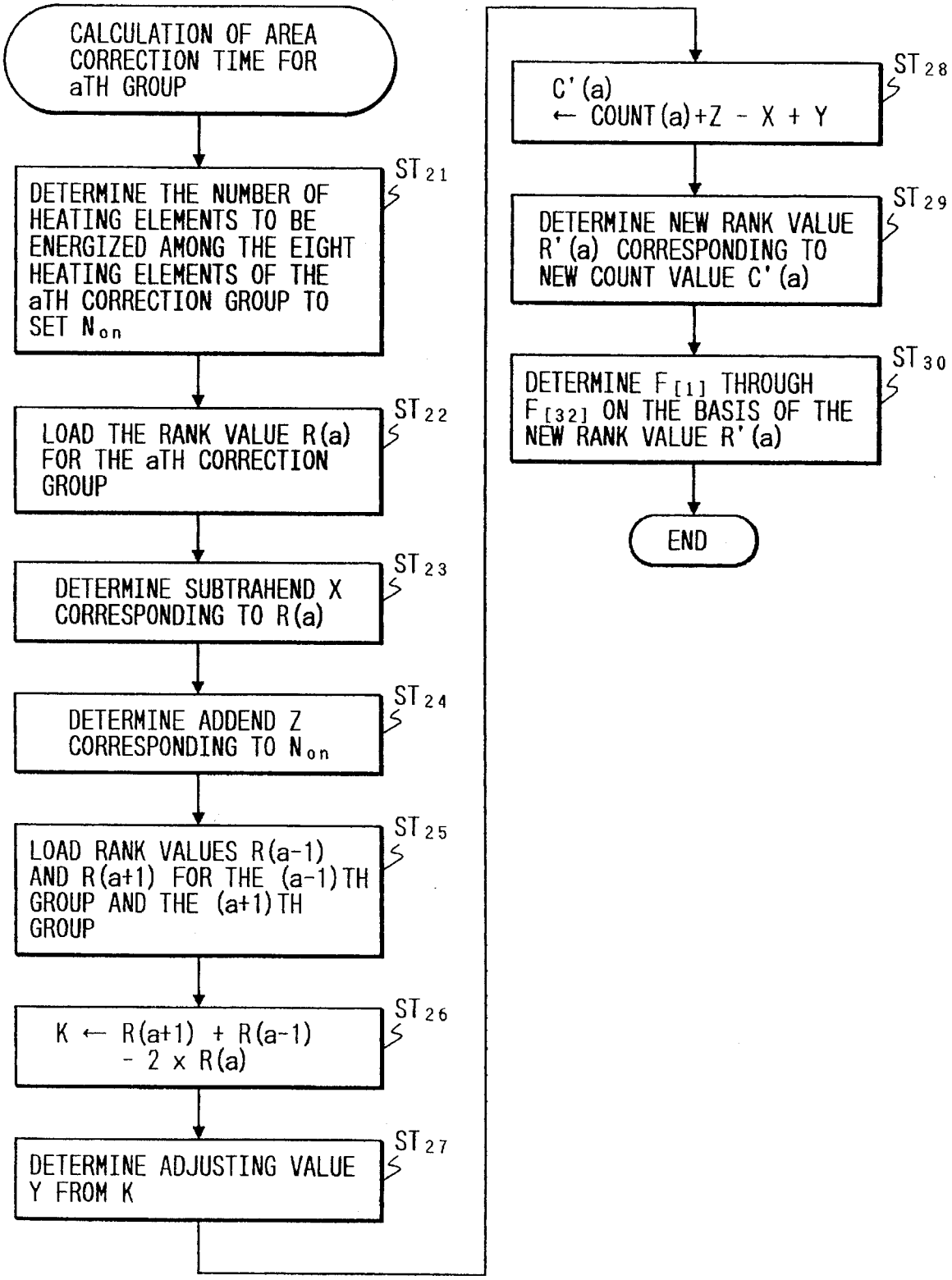
FIG. 9 is a detailed flow chart of an example of an area condition correction procedure to be carried out by the method of the present invention.

An area correction is determined on the basis of the twenty-two correction groups by procedures shown in FIGS. 8 and 9.

Referring to FIG. 8, the ath correction group (a=0) is selected in step ST11, a correction for the ath correction group is calculated in step ST12 in which the procedure shown in FIG. 9 is executed. In step ST13, a query is made to see if step ST12 has been executed for all the correction groups. If the response in step ST13 is affirmative, the procedure is ended. If the response in step ST13 is negative, the (a+1)th correction group is selected and the procedure returns to step ST12 to repeat the procedure. The step ST12 is executed repeatedly for all the twenty-two correction groups.

A procedure for determining an area condition correction for the ath correction group will be described with reference to FIG. 9.

In step ST21, an $N_{on}$ value corresponding to the number of the heating elements to be energized for the present printing cycle among the eight heating elements of the ath correction group is determined from printing information. In step ST22, a rank value R(a) for ath the correction group is loaded. The rank value R(a)=1 at the start of the printing operation and the rank value R(a) is updated every time on printing cycle is completed. The values of the rank value R(a) are stored in a memory. A procedure for updating the rank value R(a) will be described later.

In step ST23, reference is made to an R–X table shown in FIG. 10 showing rank values and corresponding subtrahends to select a subtrahend X corresponding to the rank value R(a). The subtrahend X is a factor for compensating the decrease of the temperature of the substrate 1. If the heat radiating rate of the substrate 1 is high, a large subtrahend is used. When the rank value R(a) is large, the temperature of the substrate 1 is high, the heat radiating rate of the substrate 1 is high, and hence the subtrahend is large.

In step ST24, reference is made to an $N_{on}$-Z table shown in FIG. 11 showing $N_{on}$ values and corresponding addends Z to select an addend Z corresponding to the Non value. The addend Z is a factor for compensating the increase of the temperature of the substrate 1 due to the energization of the heating elements 2. If the increase in the temperature of the substrate 1 in the present printing cycle is large, the addend Z is large. When the $N_{on}$ value is large, i.e., when the number of the heating elements 2 to be energized is comparatively large, the addend Z is comparatively large.

In this embodiment, the addend Z increases with the increase in the $N_{on}$ value from 0 for the $N_{on}$ value=0 up to 15 for the $N_{on}$ value =5, and the addend Z is fixed at 16 for the $N_{on}$ values 6, 7 and 8, because it is appropriate to the proper control of the temperature of the substrate 1 to use a small correction for suppressing the increase of the temperature of the substrate 1 by the addend Z, since the preceding condition correction for correcting the energizing time is increased when the $N_{on}$ value is large to suppress the increase of the temperature of the substrate 1 by preceding condition correction.

In step ST25, rank values R(a–1) and R(a+1) for the (a–1)th and (a+1)th correction groups are determined, and then a K value is calculated in step ST26 by using an expression:

$$K=R(a+1)+R(a-1)-2R(a)$$

Then, in step ST27, reference is made to a K–Y table shown in FIG. 12 showing K values and corresponding adjusting values Y to select an adjusting value Y corresponding to the calculated K value.

Thus, the adjusting value Y is determined to reduce the temperature difference between the correction groups through steps ST25 through step ST27. The adjusting value Y is a positive value when the rank values R(a+1) and R(a–1) of the adjacent (a+1)th and (a–1)th correction groups are greater than the rank value R(a) of the ath correction group, and the adjusting value Y is large when the difference of the rank value R(a) from the rank values R(a+1) and R(a–1) is large. The adjusting value Y is a negative value when the rank values R(a+1) and R(a–1) are smaller than the rank value R(a), and the absolute value of the adjusting value Y is large when the difference of the rank value R(a) from the rank values R(a+1) and R(a−1) is large. R values R(−1)=1 and R(22)=1 are used for calculating adjusting values for the 0th and 21th correction groups.

In step ST28, a new count C'(a) is counted by using and expression:

$$C'(a)=C(a)+Z-X+Y$$

The count represents the temperature of the ath correction group. The count is large when the temperature of the ath correction group is high. As is expressed by this expression, the new count C'(a) is obtained by adding the addend Z corresponding to the increase in temperature and the adjusting value Y, which is a negative value or a positive value) to the preceding count C(a), and subtracting the subtrahend X corresponding to the heat radiating rate from the sum of the preceding count C(a), the addend Z and the adjusting value Y. At the start of the printing operation, the count is zero. The count is zero or a positive value. If the result of calculation using the foregoing expression is a negative value, the count C'(a)=0.

In step ST29, reference is made to a C(a)–R table shown in FIG. 13 showing counts C(a) and corresponding rank values R(a) to determine a new rank value R(a). The rank value R(a) is a factor of an area condition correction expressed by: 160–2.5R(a) (μsec).

When the count is larger, the rank value is larger and the area condition correction is smaller. Therefore, the energizing time decreases with the increase of the count. The minimum energizing time which can be timed by an actual hardware is 5 μsec, and 2.5 μsec is half the possible minimum energizing time.

In step ST30, F[1] to F[32] are determined by using new rank value R'(a). As mentioned above, F[1] to F[32] are 160-bit values. The 1st correction group corresponds to the first to eighth bits, i.e., the first byte, of each of F[1] to F[32], and the nth correction group corresponds to the nth byte of each of F[1] to F[32]. A procedure for determining F[1] to F[32] will be described hereinafter, in which the nth byte of F[m] corresponding to the nth correction group will be designated as F[m][n].

When R'(n) is an even value, a new variable L is calculated by using an expression:

$$L=32=R'(n)/2$$

When R'(n) is an odd value and the printing position is an odd position, the new variable L is calculated by using an expression:

$$L=32-(R'(n)-1)/2$$

When R'(n) is an odd value and the printing position is an even position, the new variable L is calculated by using an expression:

$$L=32-(R'(n)+1)/2$$

The new variable L is an integral value. If the calculated new variable L is not an integral value, the decimal part is omitted.

A preceding condition correction E[n] is copied on F[1][n] to F[L][n]. The preceding condition correction E[n] is part of the preceding condition correction E, corresponding to the nth correction group. A bit of E[n], corresponding to the target element is 0 when the target element is not to be energized, or the same bit is 1 when the target element is to be energized. By copying E[n], the area condition correction is not provided when the target element is not to be energized.

Then, all the bits of F[L+1][n] to F[32][n] are set to 0. Thus, portions relevant to the nth correction group of F[1] to F[32] are completed. Since the 0th and 21st correction groups and are imaginary correction groups, conversion of F[1] into F[32] is not performed. The foregoing conversion is executed for the 1st to 20th correction groups to obtain the area condition corrections F[1] to F[32].

When K=6 for the nth correction group and the target element is to be energized, the corresponding bits of F[1][n] to F[6][n] are set to 1. As shown in FIG. 3, F[1], F[2], . . . and F[32] are provided sequentially at the time intervals $T_f$. Accordingly, the area condition correction time is $T_f$*5. The time interval $T_f$ is the least time interval which can be timed by the hardware. In this embodiment, $T_f$=5 μsec.

Since the maximum value of R'(n) is 32, all the bits of F[32] are always 0. Consequently, all the heating elements of the thermal print head are not energized after F[32] has been provided.

Thus, in this embodiment, the first half of the time from the point of time when F[1] is provided (FIG. 3) is the preceding condition correction time, the second half of the same is the area condition correction time, and the energizing time is the sum of the preceding condition correction time and the area condition correction time.

The method of the present invention calculates the energizing time by using logical values, the logical values are not converted into corresponding time periods and the logical values are provided sequentially.

The method of the present invention is capable of calculating the energizing time by using logical values in the 8-bit unit or the 16-bit unit and, consequently, the time required by the method of the present invention for the calculation of the energizing time is a fragment of the time required by the conventional method, which calculates time for each heating element, for the calculation of the energizing time. Furthermore, the method of the present invention needs neither complex adders nor multipliers and can be carried out by simple hardware. Therefore, the method of the present invention is advantageous in application to a high-speed thermal printing.

Since the calculated logical values are provided at predetermined time intervals, the hardware need not be provided with timers for all the heating elements and needs only a few timers; the number of timers necessary for carrying out the method of the present invention is 1/10 or less of that of timers necessary for carrying out the conventional method.

Accordingly, the method of the present invention can be carried out by hardware having a simple configuration and is capable of dealing with increase in the number of heating elements and printing speed.

As is apparent from the foregoing description, the method of controlling the printing condition of a thermal print head, in accordance with the present invention controls the heating element energizing time by calculating a plurality of logical values connected with the heating element energizing time by using a plurality of logical expressions and provides the calculated logical values sequentially at predetermined intervals instead of controlling the heating element energizing time for each heating element by means of a plurality of timers. Accordingly, the method of the present invention can be carried out by hardware having a simple configuration, and is capable of ensuring printing in a satisfactory print quality and of effectively dealing with increase in the number of heating elements and printing speed.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A method for controlling a plurality of heating elements sequentially arranged on a thermal print head of a thermal transfer printer, each of the plurality of heating elements generating an amount of heat determined by controlling an energizing time of a supply power applied during each of a plurality of printing cycles, each of the plurality of printing cycles including a preceding condition correction period and an area correction period, each preceding condition correction period including a plurality of sub-periods, the thermal transfer printer including a memory for storing activation information for each of said plurality of heating elements indicating whether supply power was applied to said heating element during each of a predetermined number of said printing cycles, the method comprising:

during each sub-period of the preceding condition correction period:

retrieving the stored activation information associated with a target heating element and for one or more heating elements located adjacent the target heating element on the thermal print head, comparing the retrieved activation information with one or more activation patterns associated with said sub-period of the preceding condition correction period, and when the retrieved activation information matches the one or more predetermined patterns associated with the sub-period, activating the heating element during the sub-period and after said preceding condition correction period, performing area condition correction wherein an area condition energization time is determined by a location of said target heating element on said thermal print head.

2. The method for controlling a printing condition of a thermal print head according to claim 1, wherein a first length of time associated with a first sub-period of the preceding condition correction period is longer than a second length of time associated with a second sub-period.

3. The method for controlling a printing condition of a thermal print head according to claim 1, wherein said activation patterns are selected to lengthen said energizing time when a diagonal line is printed.

* * * * *